US006724311B1

(12) United States Patent
Kolton et al.

(10) Patent No.: US 6,724,311 B1
(45) Date of Patent: Apr. 20, 2004

(54) ANTI-THEFT HANG TAG

(75) Inventors: Chet Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/989,863

(22) Filed: Nov. 20, 2001

Related U.S. Application Data

(60) Provisional application No. 60/344,983, filed on Nov. 9, 2001.

(51) Int. Cl.[7] ..... G08B 13/14

(52) U.S. Cl. ..... 340/572.8; 340/568.1; 340/571; 340/572.1

(58) Field of Search ..... 340/568.1, 571, 340/572.1, 572.5, 572.6, 572.8, 572.9

(56) References Cited

U.S. PATENT DOCUMENTS

| | | | | |
|---|---|---|---|---|
| 3,239,478 A | | 3/1966 | Harlan, Jr. | 428/349 |
| 3,755,803 A | | 8/1973 | Cole et al. | 340/572.1 |
| 3,919,704 A | | 11/1975 | Williams et al. | 340/572.7 |
| 4,342,904 A | | 8/1982 | Onsager | 235/493 |
| 4,510,489 A | | 4/1985 | Anderson, III et al. | 340/572.1 |
| 4,510,490 A | | 4/1985 | Anderson, III et al. | 340/572.1 |
| 4,581,524 A | | 4/1986 | Hoekman et al. | 235/493 |
| 4,694,283 A | | 9/1987 | Reeb | 340/572.5 |
| 4,725,924 A | | 2/1988 | Juan | 361/751 |
| 4,849,736 A | | 7/1989 | Cordery | 340/551 |
| 5,006,856 A | | 4/1991 | Benge et al. | 340/572.3 |
| 5,010,320 A | | 4/1991 | Cordery | 340/551 |
| 5,291,180 A | | 3/1994 | Reeb | 340/572.5 |
| 5,331,313 A | | 7/1994 | Koning | 340/551 |
| 5,345,222 A | | 9/1994 | Davies et al. | 340/572.7 |
| 5,355,120 A | | 10/1994 | Ferguson et al. | 340/572.1 |
| 5,427,099 A | | 6/1995 | Adams | 600/414 |
| 5,428,346 A | | 6/1995 | Franklin | 340/572.8 |
| 5,496,611 A | | 3/1996 | Ikeda et al. | 428/81 |
| 5,519,379 A | | 5/1996 | Ho et al. | 340/551 |
| 5,560,970 A | | 10/1996 | Ludeb uhl | 428/41.9 |
| 5,574,470 A | | 11/1996 | de Vall | 343/895 |
| 5,583,489 A | * | 12/1996 | Loemker et al. | 340/572.8 |
| 5,635,917 A | | 6/1997 | Todman | 340/825.37 |
| 5,646,592 A | | 7/1997 | Tuttle | 340/545.6 |
| 5,650,236 A | | 7/1997 | Hirano et al. | 428/611 |
| 5,710,458 A | | 1/1998 | Iwasaki | 257/679 |
| 5,714,935 A | * | 2/1998 | Ryan, Jr. | 340/572.3 |
| 5,790,029 A | * | 8/1998 | Curnutte et al. | 340/572.1 |
| 5,838,253 A | | 11/1998 | Wurz et al. | 340/10.42 |
| 5,859,587 A | | 1/1999 | Alicot et al. | 340/572.8 |
| 5,896,087 A | | 4/1999 | Frowein | 340/572.1 |
| 5,902,437 A | | 5/1999 | McDonough et al. | 156/234 |

(List continued on next page.)

*Primary Examiner*—Jeffery Hofsass
*Assistant Examiner*—Lam Pham
(74) *Attorney, Agent, or Firm*—Hoffmann & Baron, LLP

(57) ABSTRACT

An anti-theft hang tag comprises a substrate of a continuous strip of material, such as plastic, cardboard or plastic, the substrate having a first substantially planar portion and a second portion foldable relative to the first portion about a fold line. An electronic article surveillance (EAS) device is permanently adhesively secured to the substrate first portion. A separate cover portion having a substantially planar portion overlies and is permanently secured to the substrate first portion, the EAS device being permanently sealably sandwiched between the separate cover portion and the substrate first portion. In one arrangement of the anti-theft hang tag, the foldable portion is folded over the cover portion and is releaseably secured thereto by a pressure sensitive adhesive. In another arrangement of the anti-theft hang tag, the substrate foldable portion is folded under the substrate first portion and is releaseably secured thereto by a pressure sensitive adhesive. In either arrangement, a through hole is provided for receipt of a plastic tie or the like by which the hang tag may be attached to goods to be protected. Promotional and/or instructional information are provided on one or more surfaces of the hang tag.

20 Claims, 2 Drawing Sheets

U.S. PATENT DOCUMENTS

| | | | | |
|---|---|---|---|---|
| 5,920,290 | A | 7/1999 | McDonough et al. | 343/873 |
| 5,949,336 | A | 9/1999 | Deschenes et al. | 340/572.8 |
| 5,955,951 | A | 9/1999 | Wischerop et al. | 340/572.8 |
| 5,982,282 | A | 11/1999 | Ryan, Jr. | 340/572.1 |
| 5,982,284 | A | 11/1999 | Baldwin et al. | 340/572.8 |
| 6,031,458 | A | 2/2000 | Jacobsen et al. | 340/572.3 |
| 6,050,622 | A | 4/2000 | Gustafson | 292/307 R |
| 6,091,333 | A | 7/2000 | Oshima | 340/572.1 |
| 6,147,604 | A | 11/2000 | Wiklof et al. | 340/572.1 |
| 6,163,260 | A | 12/2000 | Conwell et al. | 340/572.8 |
| 6,222,452 | B1 | 4/2001 | Ahlstrom et al. | 340/572.1 |
| 6,254,953 | B1 * | 7/2001 | Elston | 428/40.1 |
| 6,433,686 | B1 * | 8/2002 | Feibelman | 340/572.8 |

* cited by examiner

ANTI-THEFT HANG TAG

This application claims priority to U.S. Provisional Application No. 60/344,983, filed on Nov. 9, 2001, entitled "Anti-Theft Hang Tag".

FIELD OF THE INVENTION

The present invention relates to an anti-theft hang tag or label of the type that is attached to a product or article and includes an electronic surveillance device secured within the tag.

BACKGROUND OF THE INVENTION

Various electronic devices are known which can be laminated into a tag or label to assist in the prevention of theft. Such electronic devices are generally printed circuit devices that transmit and/or receive a signal so as to trigger an alarm when in proximity of a compatible detector. Such electronic devices may also include electronic memory that contains product information that can be encoded into a signal used to identify the product when the signal is decoded by an appropriate decoding receiver. These electronic devices, which will be collectively referred to herein as "electric article surveillance (EAS)" devices, are commercially available. Examples of such EAS devices are described in U.S. Pat. Nos. 5,949,336; 5,955,951; 5,982,284 and 6,254,953.

On problem associated with an anti-theft hang tag is that if a potential shoplifter recognizes the tag as an anti-theft device, there may be an attempt to remove the tag from the merchandise. Accordingly, it is desirable to provide a tag, such as a hang tag wherein the EAS device is hidden and less obtrusive, making it less identifiable to potential shop lifters. In addition, it is desirable to provide a hang tag of such size and configuration that can be attached to an article or merchandise in a manner that will allow a potential purchaser to try-on or examine the merchandise before purchase. It is further desirable to present visual, promotional or instructional information on the hang tag to not only eliminate the need for additional information tags, but to contribute to the inconspicuousness of the hidden EAS device.

SUMMARY OF THE INVENTION

In accordance with one aspect of the present invention, an anti-theft hang tag comprises a substrate having a first substantially planar portion and a second portion foldable relative to the first portion about a fold line. An electronic surveillance device (EAS) is provided on the substrate first portion. A separate, substantially planar cover portion overlies and is permanently secured to the substrate first portion. The EAS is permanently sealably sandwiched between the separate cover portion and the substrate first portion, thereby defining a sealed tag portion. The substrate second portion is foldable about the fold line for releaseable securement with the sealed tag portion.

In a particular aspect of the present invention wherein an anti-theft apparatus is adapted for use as a hang tag or label for attachment to goods to be protected, the substrate second foldable portion is folded over the cover portion and releaseably secured to the cover portion by a pressure sensitive adhesive.

In a further aspect of the present invention wherein an anti-theft apparatus is adapted for use as a hang tag or label for attachment to goods to be protected, the substrate second foldable portion is folded over the substrate first portion and releaseably secured to the substrate first portion by a pressure sensitive adhesive.

In accordance with a method for making an anti-theft hang tag pursuant to the present invention, a substrate of a continuous strip of material is provided, wherein the substrate has a first substantially planar portion and a second substantially planar portion foldable relative to the first portion about a fold line. An electronic surveillance device (EAS) is placed on a surface of the first portion and a permanent adhesive is deposited on the substrate first portion and substantially around the EAS device. A separate cover portion is placed over the substrate first portion in permanently secured relation with the permanent adhesive, sealably sandwiching the EAS device between the cover portion and the substrate first portion in a sealed tag portion. A through hole is provided at least through the substrate for receipt of an attachment device for hanging the tag on goods to be protected. The substrate second folded portion is folded over the sealed tag portion and releasebly secured to the sealed tag portion by depositing a pressure sensitive adhesive between the substrate second foldable portion and the sealed tag portion.

DETAILED DESCRIPTION OF THE INVENTION

Figure 1:
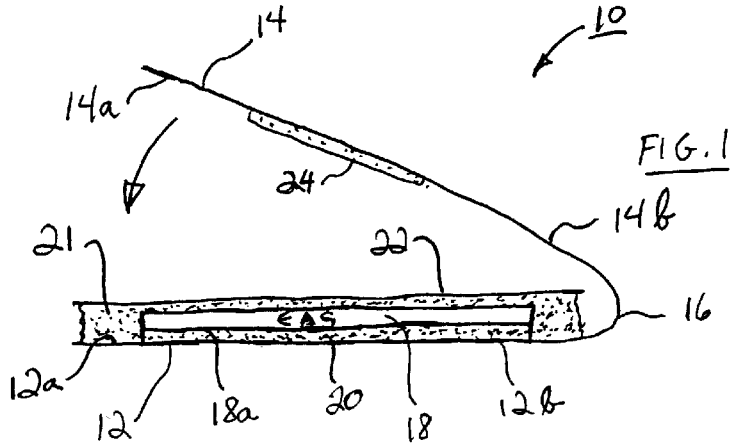
FIG. 1 is a side elevation view of one embodiment of the subject hang tag, showing the tag in a partially folded position.

Referring now the drawing figures, an anti-theft hang tag 10 in accordance with one embodiment of the invention includes a lower portion 12 and an upper portion 14 being foldable relative to each other about fold line 16. On the upper surface 12*a* of lower portion 12 an electronic article surveillance (EAS) device 18 is disposed. As noted hereinabove, EAS devices are well known and may include electronic circuitry for article surveillance purposes, such as disclosed in U.S. Pat. No. 5,949,336, or combined with product identification capability such as shown in U.S. Pat. No. 5,955,951. The disclosures of the '336 and '951 patents are incorporated herein by reference in their entirety.

EAS device 18 is permanently secured to the inner surface 12*a* of substrate 12 by means of a conventional permanent adhesive 20 that may be applied to the bottom surface of EAS device 18 or to the inner surface 12*a* beneath EAS device 18. Additional permanent adhesive 21 is then applied substantially around outer surface 18*a* of EAS device 18 and over substantially the entire area of inner surface 12*a*. A separate cover portion 22, of size and area substantially coincident with the size and area of the lower portion 12, is applied over the permanent adhesive 21 and the EAS device 18 to permanently seal and secure the EAS device 18 within hang tag 10. The separate cover portion 22 can also be of a size and shape somewhat less coincidental than shown herein provided the separate cover portion achieves the effect of securing an EAS device and obscuring it visually. It should also be understood that EAS device 18 may be permanently secured between inner surface 12*a* and separate cover portion 22 by a single layer of permanent adhesive or other suitable methods or materials, as long as the cover portion 22 and lower portion 12 are permanently sealed and secured with the EAS device 18 affixed therebetween.

A conventional pressure sensitive adhesive 24 is applied to a portion of the inner surface 14*a* of the upper folded portion 14 so that when the foldable portions 12 and 14 are brought together, upper portion 14 is removably secured to the cover portion 22, which is permanently secured to the lower portion 12. It should be appreciated that pressure sensitive adhesive 24 may alternatively be applied to the upper surface of separate cover portion 22 for removable attachment to the inner surface 14*a* of the upper foldable portion 14 when foldable portions 12 and 14 are brought together.

In the embodiment of FIG. 1, foldable portions 12 and 14 are preferably formed from a continuous strip of paper. Similarly, cover portion 22, which is formed separate and apart from foldable portions 12 and 14, is also preferably formed of paper. The paper strip defining foldable portions 12 and 14, as well as the separate paper cover portion 22, may have a gloss finish for added stiffness and appearance. It should be appreciated that foldable portions 12 and 14 as well as separate cover portion 22 may be formed of other suitable materials, such as plastic, fabric or cardboard, and may be covered with coatings or films of thermoplastic or other suitable materials for appearance, protection and rigidity.

Figure 2:
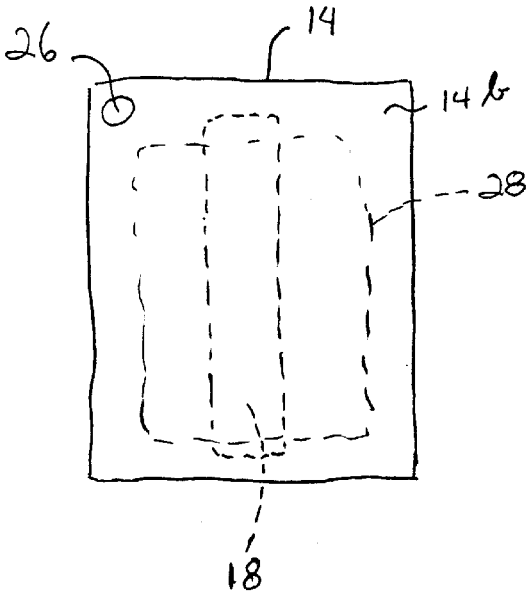
FIG. 2 is a top plan view of the hang tag of FIG. 1.
Figure 3:
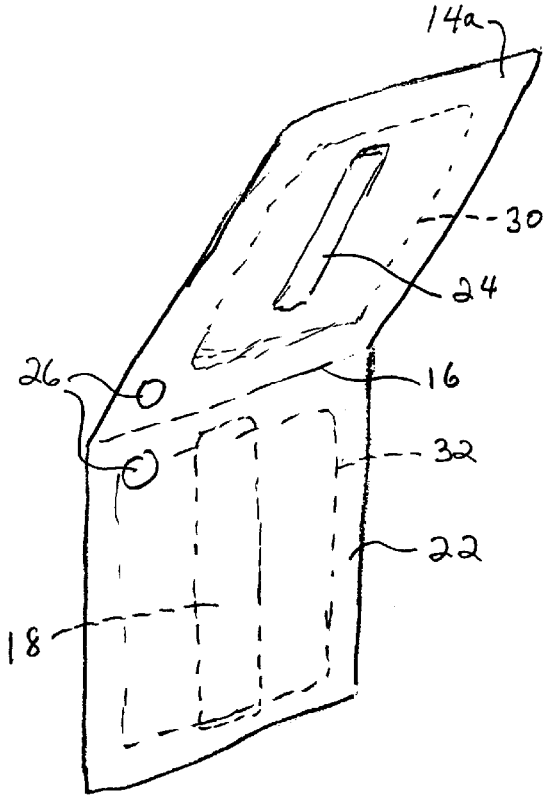
FIG. 3 is a perspective view of the hang tag of FIG. 1, shown in a more fully open position.

Turning now to FIG. 2, hang tag 10 is shown in its fully folded position, with outer surface 14*b* of the upper portion 14 being shown. A through-hole 26 is provided to extend through the upper portion 14, the cover portion 22 and the lower portion 12 for receipt of a plastic tie, string or the like for attachment of the hang tag 10 to an article or merchandise. Promotional or other instructional information may be printed on the outer surface 14*b* as shown by dashed line 28, as well as on the outer surface 12*b* of the lower portion 12 (not shown). Similarly, as illustrated in FIG. 3, promotional or instructional information may be printed on the inner surface 14*a* and the upper surface of the cover portion 22 as shown by dashed lines 30 and 32, respectively. With the EAS device 18 being permanently secured between the lower portion 12 and the separate cover portion 22, the EAS device 18 which is typically relatively thin, is suitably hidden from a casual observer. Furthermore, the printed promotional and/or instructional information on both the inner and outer surfaces of the hang tag 10 tend to mask the identity of the tag as an anti-theft device.

Figure 4:
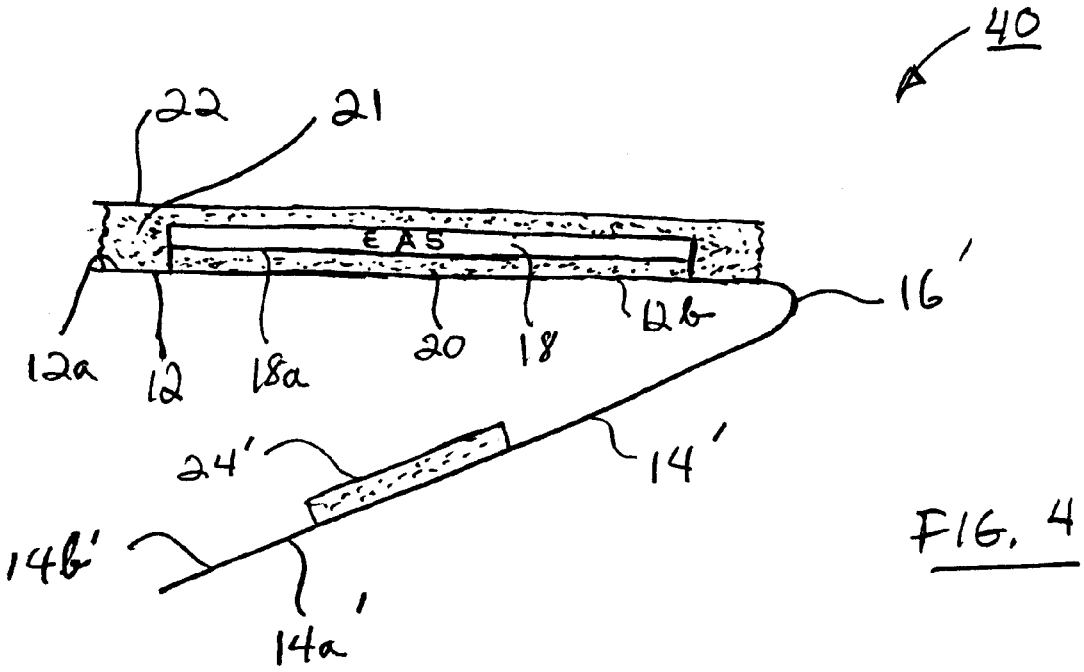
FIG. 4 is a side elevation view of the hang tag in accordance with another embodiment, showing the tag in a partially folded position.

Referring now to FIG. 4, another embodiment of the subject invention is depicted. The hang tag 40 shown in FIG. 4 is similar to the embodiment of FIG. 1 in the manner in which the EAS device 18 is secured between foldable portion 12 and separate cover portion 22 by permanent adhesives 20 and 21. However, in this embodiment being described, foldable portion 14' is not folded over separate cover portion 22 but is rather folded about fold line 16' beneath foldable portion 12. In this embodiment, pressure sensitive adhesive 24' is disposed on inner surface 14*b*' for removable securement of the foldable portion 14' to foldable portion 12. As with the embodiment of FIG. 1, the pressure sensitive adhesive 24' may, in the alternative, be applied to the lower surface 12*b* of foldable portion 12 for removable securement of the foldable portions 12 and 14. Promotional and/or instructional information may be printed on the outer and inner surfaces as described with respect to the embodiment of FIG. 1. Likewise, the materials from which the anti-theft hang tag 40 are made may be the same as those described with respect to FIG. 1.

Having described the preferred embodiment of the anti-theft apparatus particularly adapted for use as a hang tag or label, it should be appreciated that modifications may be made thereto without departing from the contemplated scope of the invention. Accordingly, the preferred embodiments described herein are intended to be illustrative rather than limiting, the true scope of the invention being set forth in the claims appended hereto.

What is claimed is:

1. An anti-theft hang tag, comprising:

a substrate having a first substantially planar portion and a second portion foldable relative to said first portion about a fold line;

an electronic article surveillance (EAS) device on said substrate first portion; and a separate substantially planar cover portion overlying and permanently secured to said substrate first portion, said EAS device being permanently sealably sandwiched between said separate cover portion and said substrate first portion, defining a sealed tag portion, said substrate second portion being foldable about said fold line for releaseable securement with said sealed tag portion.

2. An anti-theft tag according to claim 1, wherein a permanent adhesive is disposed between said cover portion of said substrate first portion and about said EAS device.

3. An anti-theft tag according to claim 2, wherein said substrate first portion and said substrate second foldable portion are formed as a continuous strip.

4. An anti-theft tag according to claim 2, wherein said cover portion is formed to be of size and shape approximately the same as the size and shape of the substrate first portion.

5. An anti-theft tag according to claim 2, wherein indicia is provided on a surface of said cover portion.

6. An anti-theft tag according to claim 2, wherein indicia is provided on a surface of said substrate foldable portion.

7. An anti-theft tag according to claim 2, wherein indicia is provided on a surface of said substrate first portion.

8. An anti-theft tag according to claim 2, wherein said hang tag has a through hole for receipt of an attachment device for hanging said tag.

9. An anti-theft tag according to claim 8, wherein said through hole extends through said substrate first portion, said substrate second foldable portion and said cover portion.

10. An anti-theft tag according to claim 2, wherein said substrate and said cover portion are formed from the group of materials consisting of paper, plastic, fabric and cardboard.

11. An anti-theft tag according to claim 10, wherein said materials of said substrate and said cover portions are provided with a protective coating.

12. An anti-theft tag according to claim 1, wherein said substrate foldable portion is foldable over said cover portion, and wherein a releaseable, pressure sensitive adhesive is disposed between said cover portion and said substrate foldable portion.

13. An anti-theft tag according to claim 1, wherein said substrate foldable portion is foldable over said substrate first portion, and wherein a releasable, pressure sensitive adhesive is disposed between said substrate first portion and said substrate foldable portion.

14. An anti-theft apparatus, comprising:

a substrate being formed of a continuous strip of material having a first substantially planar portion and a second substantially planar portion being foldable relative to said first portion about a fold line, a separate cover portion formed to have a size and shape substantially the same as the size and shape of said substrate first portion and overlying said first portion;

an electronic article surveillance (EAS) device permanently secured between said substrate first portion and said cover portion by a permanent adhesive, said substrate second foldable portion being folded over said cover portion and releaseably secured thereto by a pressure sensitive adhesive.

15. An anti-theft apparatus according to claim 14 adapted for use as a hang tag or label for attachment to goods to be protected, further comprising a through hole for receipt of an attachment device for hanging said tag or label.

16. An anti-theft apparatus according to claim 15, wherein indicia of promotional or institutional information is disposed on a surface of said cover portion and on a surface of said substrate foldable portion.

17. An anti-theft hang apparatus, comprising:

a substrate being formed of a continuous strip of material having a first substantially planar portion and a second substantially planar portion being foldable relative to said first portion about a fold line, a separate cover portion formed to have a size and shape substantially the same as the size and shape of said substrate first portion and overlying said first portion;

an electronic article surveillance (EAS) device permanently secured between said substrate first portion and said cover portion by a permanent adhesive, said substrate second foldable portion being folded over said substrate first portion and releaseably secured thereto by a pressure sensitive adhesive.

18. An anti-theft apparatus according to claim 17 adapted for use as a hang tag or label for attachment to goods to be protected, further comprising a through hole for receipt of an attachment device for hanging said tag or label.

19. An anti-theft apparatus according to claim 17, wherein indicia of promotional or institutional information is disposed on a surface of said substrate first portion and on a surface of said substrate foldable portion.

20. A method for making an anti-theft hang tag, comprising the steps of:

providing a substrate of a continuous step of material having a first substantially planar portion and a second substantially planar portion foldable relative to said first portion about a fold line, placing an electronic article surveillance (EAS) device on a surface of said substrate first portion;

depositing on said substrate first portion and substantially around said EAS device a permanent adhesive;

placing a separate cover portion over said substrate first portion in permanently secured relation with said permanent adhesive sealably sandwiching said EAS device between said cover portion of said substrate first portion in a sealed tag portion;

providing a through hole at least through said substrate for receipt of an attachment device for hanging said tag on goods to be protected;

folding said substrate second foldable portion over said sealed tag portion; and releaseably securing said substrate second foldable portion to said sealed tag portion by depositing a pressure sensitive adhesive between said substrate second foldable portion and said sealed tag portion.

* * * * *